US006543393B1

(12) United States Patent
Cunningham

(10) Patent No.: US 6,543,393 B1
(45) Date of Patent: Apr. 8, 2003

(54) FIRE SUPPRESSING WATER HEATER SYSTEM

(76) Inventor: Kenneth G. Cunningham, 5601 Bandera, PMB 445, San Antonio, TX (US) 78238-1979

( * ) Notice: Subject to any disclaimer, the term of this patent is extended or adjusted under 35 U.S.C. 154(b) by 0 days.

(21) Appl. No.: 10/112,919

(22) Filed: Mar. 29, 2002

(51) Int. Cl.[7] ..... A62C 39/00

(52) U.S. Cl. ..... 122/504.3; 122/14.1; 122/14.3; 169/68

(58) Field of Search ..... 122/14.1, 14.3, 122/504, 504.3, 506, 504.2; 169/37, 70, 68, 58, 57

(56) References Cited

U.S. PATENT DOCUMENTS 2,245,144 A * 6/1941 Griffith ..... 169/37
2,967,666 A * 1/1961 Carlson ..... 236/12.2
4,023,164 A * 5/1977 Delaney ..... 122/504.2
4,343,364 A * 8/1982 Glinecke ..... 169/38

* cited by examiner

*Primary Examiner*—Gregory Wilson
(74) *Attorney, Agent, or Firm*—Gold & Rizvi, P.A.; H. John Rizvi; Glenn E. Gold

(57) ABSTRACT

A fire suppressing water heater system is provided including a fire suppressing water heater system is provided including a water heater, fire detection means, spray means, and water transport means. The water heater will preferably include a cold water intake and a hot water return. The spray means are designed to activate when a fire is present in the proximity of the water heater so as to quickly extinguish the fire. Fire detecting means may be configured to activate the spray means when evidence of a fire, such as heat or smoke, for example, is detected. Furthermore, in the event of a fire, water transport means direct a quantity of water from the cold water intake of the water heater to the spray means.

19 Claims, 2 Drawing Sheets

FIRE SUPPRESSING WATER HEATER SYSTEM

BACKGROUND OF THE INVENTION

1. Field of the Invention

The present invention relates generally to water heaters for use in residential, commercial, and industrial buildings, including mobile homes and recreational vehicles, and more particularly, to a fire suppressing water heater system configured to quickly extinguish a fire in the proximity of a water heater.

2. Description of the Prior Art

A significant percentage of the origin of home and business fires have been traced to faulty gas or electric water heaters. The use of such water heaters has become commonplace in residential, commercial, and industrial buildings, including mobile homes and recreational vehicles, and is now the primary method of providing heated water throughout indoor plumbing fixtures such as, for example, sinks, bathtubs, showers, washing machines, and the like.

Water heaters typically include a large tank for storage and a thermostat to monitor the temperature of the stored water. Due to space considerations, the water heater is usually located in a basement, garage, attic, or other remote location in a home or business. Water heaters are known to pose a significant fire hazard due to a wide variety of factors such as, for example, faulty installation, inadequate electrical connections, poor ventilation, equipment age, and the presence of flammable vapors and materials. The remote location of most water heaters, such as in an attic or garage, for example, increases the likelihood that a fire will go undetected in its early stages. A fire that starts in the basement, for example, may destroy much of the structural foundation of a home before it is detected and extinguished. Placement of smoke detectors in the basement and attic of buildings has shortened the time that elapses before the start of a fire and its detection. Unfortunately, smoke detectors and other fire detecting devices have are useless, by themselves, in those instances where nobody is physically present to intervene and extinguish the fire. Standard fire extinguishers and other fire fighting equipment, likewise, is of no use without active human intervention.

Commercial buildings have utilized automatic fire sprinklers with some success. Such systems, however, are relatively cumbersome, expensive, and time-consuming to install. As such, few homes, mobile homes, or recreational vehicles are built equipped with an automatic sprinkler system. The costs of remodeling existing buildings to include such systems are necessarily exorbitant offer an impractical solution, at best, to reducing fire losses traced to water heaters. Although water heaters have evolved considerably over the years, existing water heaters have not been successful in detecting and extinguishing fires originating therein or in their immediate proximity.

Accordingly, there is an established need for a safe, practical, and inexpensive fire suppressing water heater system capable of quickly extinguishing a fire in the proximity of a water heater.

SUMMARY OF THE INVENTION

The present invention is directed to a safe, practical, and inexpensive fire suppressing water heater system that is capable of quickly extinguishing a fire in the proximity of a water heater. The fire suppressing water heater system includes a water heater, fire detection means, spray means, and water transport means. The water heater will preferably include a cold water intake and a hot water return. The spray means are designed to activate when a fire is present in the proximity of the water heater so as to quickly extinguish the fire and minimize property damage and personal injury losses. The presence of a fire may be detected by fire detecting means. Fire detecting means may further be configured to activate the spray means when evidence of a fire, such as heat or smoke, for example, is detected. In the event of a fire, water transport means direct a quantity of water from the cold water intake of the water heater to the spray means.

An object of the present invention is to provide a fire suppressing water heater system that can be adapted for use with a wide variety of water heaters.

A further object of the present invention is to provide a fire suppressing water heater system that is relatively inexpensive to install and maintain.

Another object of the present invention is to provide a fire suppressing water heater system that is configured to quickly and safely extinguish a fire detected in the proximity of a water heater.

An additional object of the present invention is to provide a fire suppressing water heater system that is configured to automatically activate upon detecting the presence of a fire.

In accordance with a first aspect of the invention, a fire suppressing water heater system is provided including a water heater, fire detection means, spray means, and water transport means. The water heater will preferably include a cold water intake and a hot water return. The spray means are designed to activate when a fire is present in the proximity of the water heater so as to quickly extinguish the fire. The presence of.a fire may be detected by fire detecting means. Fire detecting means may also be configured to activate the spray means when evidence of a fire, such as heat or smoke, for example, is detected. Furthermore, in the event of a fire, water transport means direct a quantity of water from the cold water intake of the water heater to the spray means.

Another object of the present invention is to provide a fire suppressing water heater system that is capable of automatically extinguishing a fire in the proximity of a water heater without any human intervention.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed towards a safe, practical, and low-cost fire suppressing water heater system that is capable of quickly extinguishing a fire in the proximity of a water heater. The fire suppressing water heater system 100 of the present invention is preferably configured for use with a wide variety of water heaters.

Figure 1:
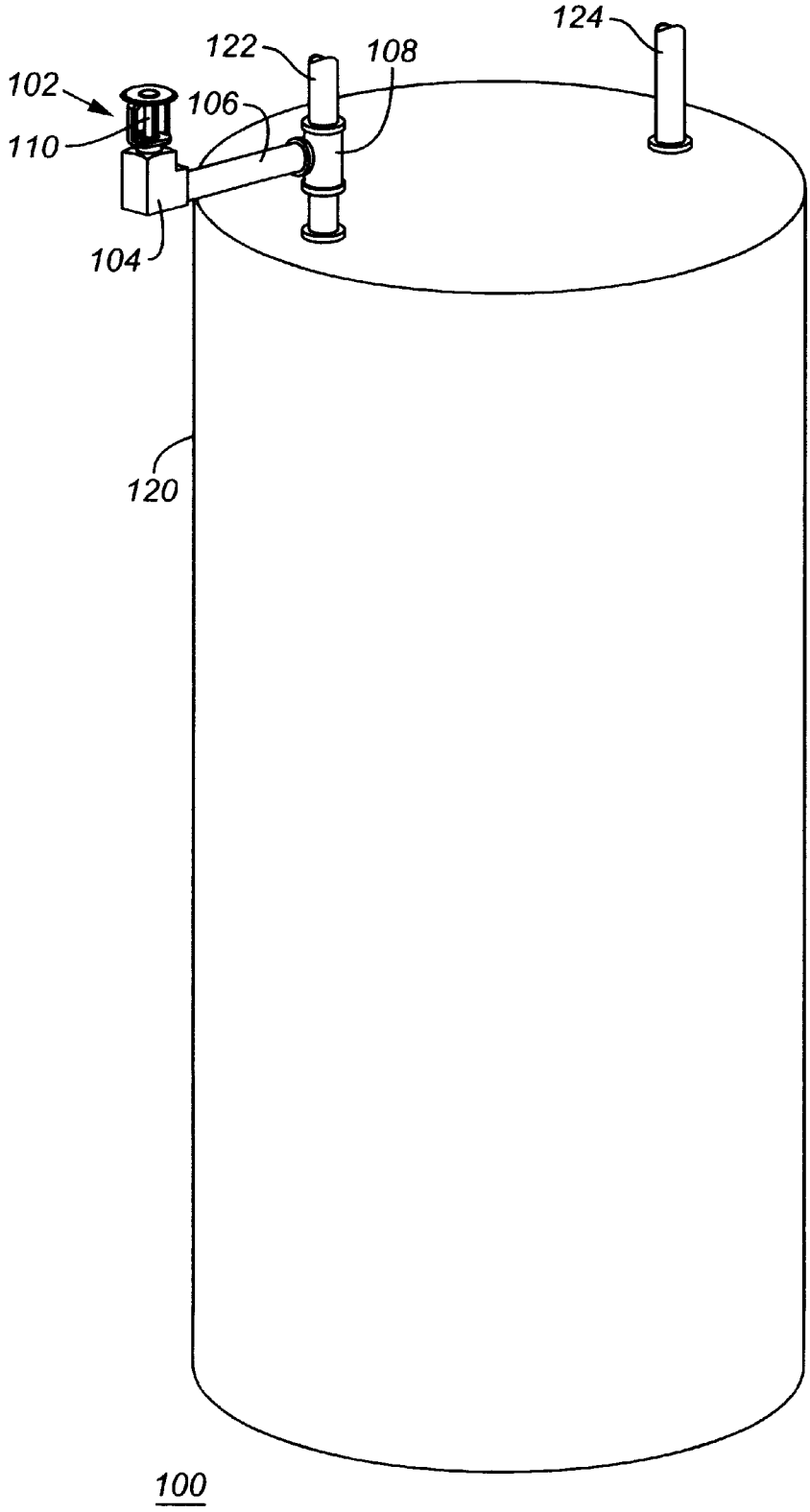
FIG. 1 is a perspective view showing a preferred embodiment of the fire suppressing water heater system of the present invention.

Referring now to FIG. 1, a fire suppressing water heater system, shown generally as reference number 100, is illustrated in accordance with a preferred embodiment of the present invention. As shown, the fire suppressing water heater system 100 includes a water heater 120 having a cold water intake 122 and a hot water return 124. Any of a wide variety of existing water heaters may be utilized. As such, water heater 120 may be configured as a gas, electric, or solar-powered water heater, for example, without departing from the present invention. Water is supplied to the water heater 120 via a cold water intake 122 directed from the main water supply. Heated water exits the water heater 120 through the hot water return 124 and is piped throughout plumbing fixtures such as, for example, sinks, bathtubs, showers, washing machines, and the like.

In the fire suppressing water heating system 100 of the present invention, spray means are preferably disposed near the water heater 120 and configured to activate when a fire is present in the proximity of the water heater 120. It will be appreciated by those skilled in the art that any of a wide variety of different spray means may be utilized without departing from the present invention. In a most preferred embodiment, the spray means includes a sprinkler head 102 as shown. The sprinkler head 102 will preferably be placed in relatively close proximity to the water heater 120 so that water exiting the sprinkler head 102 can douse the water heater 120 in the event of a fire. In addition to the primary sprinkler head 102, additional sprinkler heads may also be utilized, if desired, without departing from the present invention.

Figure 2:
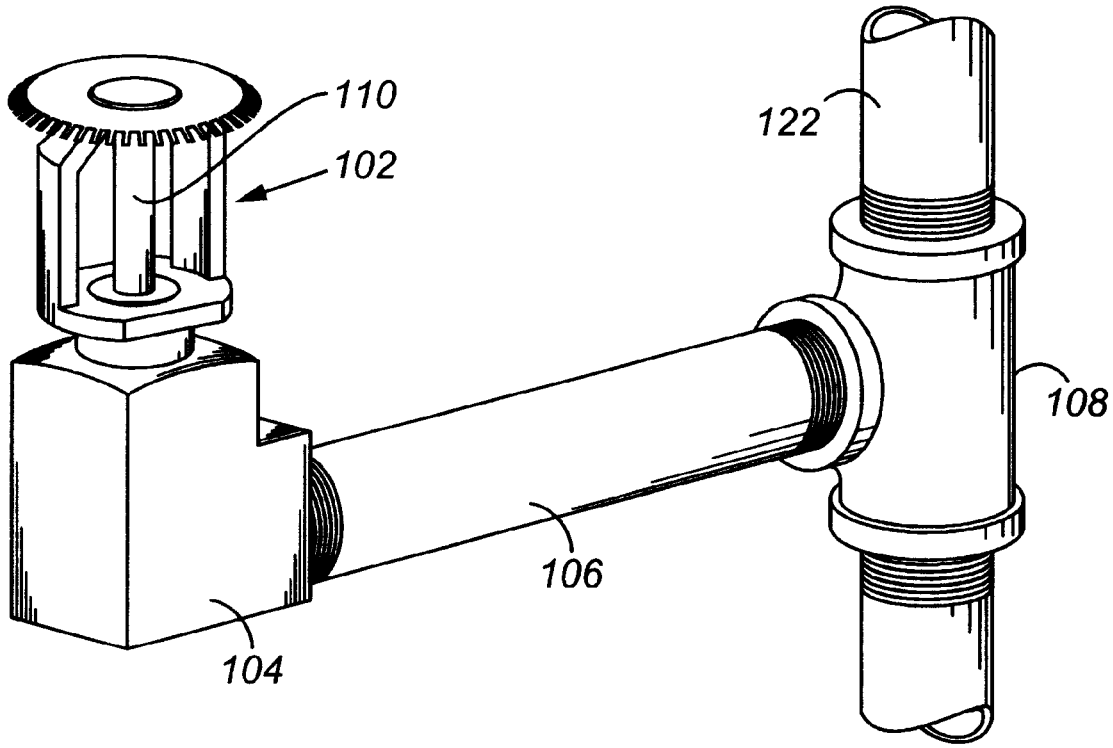
FIG. 2 is a perspective view focusing on a portion of the preferred embodiment of the fire suppressing water heater system of the present invention without the water heater.

The fire suppressing water heater system 100 of the present invention includes water transport means configured to direct a quantity of water from the cold water intake 102 to the sprinkler head 102. The water transport means may include any of a wide variety of pipes, flexible and rigid hoses, plumbing connections, and other items suitable for use as a conduit. In a most preferred embodiment, the water transport means includes a T-shaped connector 108, elbow connector 104, and pipe 106 which may be configured to cooperate as illustrated in FIG. 2. If desired, the T-shaped connector 108, elbow connector 104, and pipe 106 may be threaded, as shown, to permit easy assembly. The elements shown are for illustrative purposes only and it will be appreciated by those skilled in the art that a wide variety of other plumbing configurations may also be utilized without departing from the present invention. The specific configuration used will depend upon a variety of location specific factors including, for example, the desired proximity of the sprinkler head 102 to the water heater 120.

The fire suppressing water heater system 100 of the present invention may include, if desired, fire detecting means configured to activate the sprinkler head or other spray means in the event that evidence of a fire is detected. Any of a wide variety of known fire detecting means, such as smoke detectors and heat detectors, for example, may be utilized for this purpose without departing from the present invention. In a most preferred embodiment, the fire detecting means will include a heat detector to signal the presence of a fire near the water heater 120. Most preferably, the heat detector will be a liquid-filled glass bulb 110 disposed within the sprinkler head 102. The liquid-filled glass bulb 110 will preferably be a frangible bulb configured to break upon reaching a preset temperature (indicating the presence of a fire) and activate the sprinkler head 102 so that water from the cold water intake 122 can exit the sprinkler head 102 and douse the water heater 120 and surrounding areas. The liquid-preferably filled glass bulb 110 will preferably be configured to break at a temperature of approximately 155–168 degrees Fahrenheit.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A fire suppressing water heater system comprising:

a water heater having a cold water intake and a hot water return;

at least one spray means disposed near said water heater and configured to activate when a fire is present in a proximity of said water heater; and water transport means configured to direct a quantity of water from said cold water intake to said spray means.

2. A fire suppressing water heater system as recited in claim 1, further comprising fire detecting means configured to activate said spray means when evidence of a fire is detected.

3. A fire suppressing water heater system as recited in claim 2, wherein said fire detecting means comprises a smoke detector.

4. A fire suppressing water heater system as recited in claim 2, wherein said fire detecting means comprises a heat detector.

5. A fire suppressing water heater system as recited in claim 4, wherein said heat detector comprises a liquid-filled bulb configured to break upon reaching a preset temperature.

6. A fire suppressing water heater system as recited in claim 1, wherein said spray means comprises a sprinkler head.

7. A fire suppressing water heater system as recited in claim 6, wherein said sprinkler head is heat activated.

8. A fire suppressing water heater system comprising:

a water heater having a cold water intake and a hot water return;

at least one spray means disposed near said water heater and configured to activate when a fire is present in a proximity of said water heater;

water transport means configured to direct a quantity of water from said cold water intake to said spray means; and fire detecting means configured to activate said spray means when evidence of a fire is detected.

9. A fire suppressing water heater system as recited in claim 8, wherein said fire detecting means comprises a smoke detector.

10. A fire suppressing water heater system as recited in claim 8, wherein said fire detecting means comprises a heat detector.

11. A fire suppressing water heater system as recited in claim 10, wherein said heat detector comprises a liquid-filled bulb configured to break upon reaching a preset temperature.

12. A fire suppressing water heater system as recited in claim 8, wherein said spray means comprises a sprinkler head.

13. A fire suppressing water heater system as recited in claim 10, wherein said sprinkler head is heat activated.

14. A fire suppressing water heater system as recited in claim 11, wherein said sprinkler head is smoke activated.

15. A fire suppressing water heater system comprising:

a water heater having a cold water intake and a hot water return;

at least one sprinkler head disposed near said water heater;

water transport means configured to direct a quantity of water from said cold water intake to said sprinkler head; and heat detecting means disposed between said cold water intake and said sprinkler head, said heat detecting means configured to permit water to exit said sprinkler head when a preset temperature is detected.

16. A fire suppressing water heater system as recited in claim 15, wherein said water transport means comprises a variety of plumbing connections configurable as a conduit.

17. A fire suppressing water heater system as recited in claim 16, wherein said variety of plumbing connections includes at least one T-connector.

18. A fire suppressing water heater system as recited in claim 16, wherein said variety of plumbing connections includes at least one elbow connector and at least one pipe.

19. A fire suppressing water heater system as recited in claim 15, wherein said heat detecting means includes a liquid-filled bulb configured to break upon reaching a preset temperature so as to permit water from said cold water intake to exit said sprinkler head.

* * * * *